United States Patent [19]

Dennhardt

[11] 4,166,590

[45] Sep. 4, 1979

[54] PROCESS AND APPARATUS FOR MAINTAINING A CONSTANT MATERIAL WEB SPEED DURING WINDING OPERATIONS

[75] Inventor: Werner Dennhardt, Taunusstein, Fed. Rep. of Germany

[73] Assignee: Hoechst Aktiengesellschaft, Frankfurt am Main, Fed. Rep. of Germany

[21] Appl. No.: 874,627

[22] Filed: Feb. 2, 1978

[30] Foreign Application Priority Data

Feb. 4, 1977 [DE] Fed. Rep. of Germany ..... 2704610

[51] Int. Cl.[2] ..... B65H 23/20

[52] U.S. Cl. ..... 242/75.51

[58] Field of Search ..... 242/75.51, 75.5, 75.52, 242/75.53, 67.1 R, 67.3 R; 318/6

[56] References Cited

U.S. PATENT DOCUMENTS

| | | | |
|---|---|---|---|
| 2,539,540 | 1/1951 | Idor | 318/6 X |
| 2,916,227 | 12/1959 | Bowen | 242/75.5 |
| 3,762,663 | 10/1973 | Nedreski | 242/75.51 |
| 3,910,521 | 10/1975 | O'Callaghan | 318/6 |

FOREIGN PATENT DOCUMENTS

| | | | |
|---|---|---|---|
| 922471 | 1/1955 | Fed. Rep. of Germany | 242/75.51 |
| 1499122 | 10/1965 | Fed. Rep. of Germany | 242/75.51 |

*Primary Examiner*—Edward J. McCarthy

*Attorney, Agent, or Firm*—Schwartz, Jeffery, Schwaab, Mack, Blumenthal & Koch

[57] ABSTRACT

Disclosed is a process and an apparatus for use therewith for maintaining a constant material web speed during winding of the material onto a driven roll. The process comprises adjusting the speed of the drive motor of the roll to be linearly proportioned to its control voltage; and, as the diameter of the roll increases due to the winding of material thereon, reducing the speed of the drive motor in accordance with a hyperbolic curve relating motor speed to the diameter of the roll characteristic of the winding operation.

10 Claims, 4 Drawing Figures

PROCESS AND APPARATUS FOR MAINTAINING A CONSTANT MATERIAL WEB SPEED DURING WINDING OPERATIONS

BACKGROUND OF THE INVENTION

The present invention relates to a process for maintaining a constant tensile load on material during winding operations wherein the tensile load is kept constant by maintaining a constant material web speed during winding, and to a control arrangement suitable for use therein.

When processing material in web form it is frequently necessary for the web material to be temporarily wound onto a roll, before it can be further processed. A necessary condition for this is the maintenance of a constant tensile load thereon which, in general, can be achieved by providing a constant material web speed. In the paper and rolling mill industries, Ward-Leonard drives are customarily employed as control units for so-called hyperbolic winders in order to maintain a constant tensile load. The control units used therein are designed for large load drives and exhibit a high technical complexity. The high technical complexity and the large capital outlay characteristic of Ward-Leonard drives renders them undesirable for use with small load or power drives. Accordingly, there exists a great need in the art for a control system suitable for use with small load or power drives.

The winding of material in tape or wire form under a constant tensile load will be a process of constant power if the supply or web speed of the material is maintained constant. The change in the diameter of the winding of a roll as it picks up material will not change this relationship provided the web speed is maintained constant. It is true that, as the diameter of the winding becomes greater, the speed of the motor which drives the wind-up roll falls, however, at the same time its torque increases. Since the product of the drive motor's speed and torque gives its mechanical power, which corresponds to the tensile load on the material to be wound, and which remains essentially constant, a decrease in drive motor speed will not alter the tensile load if a constant web speed is maintained.

SUMMARY OF THE INVENTION

Accordingly, it is an object of the present invention to provide a process for maintaining a constant tensile load during winding operations as the diameter of the wind-up roll increases which is suitable for use with small load or power drives.

It is a specific object of the present invention to provide a process for maintaining a constant tensile load upon a material during winding by maintaining the web speed of the material at a constant preselected value as the diameter of the wind-up roll increases.

An additional object of the instant invention is the provision of a control arrangement which maintains the drive motor of a winding apparatus at a constant mechanical power.

In accomplishing the foregoing and other objects, there has been provided in accordance with the present invention a process for maintaining a constant material web speed during winding of a material onto a driven roll, which comprises adjusting the speed of the drive motor of the wind-up roll to be linearly proportional to its control voltage; and, as the diameter of the roll increases due to the winding of material thereon, reducing the speed of the drive motor in accordance with a hyperbolic curve relating motor speed to the diameter of the wind-up roll characteristic of the winding operation. In the preferred embodiment, this is preferably achieved by measuring the increase in diameter of the wind-up roll, and hyperbolically decreasing the control voltage of the drive motor as a function of the increase in roll diameter. Preferably the control voltage is hyperbolically decreased as a function of the roll diameter by measuring the increase in the diameter of the wind-up roll as material is wound thereon, and then decreasing an adjustable resistance in the control voltage proportionally to the increase in roll diameter.

As used herein, the term "hyperbolically decreasing the control voltage as a function of the increase in roll diameter" means decreasing the control voltage in accordance with the equation:

$$U_1 = U_o\left(\frac{R_1}{a \cdot d + R_1}\right)$$

where $U_1$ is the drive motor control voltage, $U_o$ is the constant input voltage, $R_1$ is the resistance of the control voltage $U_1$, d is the diameter of the wind-up roll, and a is a constant, as will be explained more fully hereinafter.

In another embodiment of the instant invention, a control arrangement is provided for use in the process contemplated by the instant invention. This control arrangement comprises a controller for controlling the speed of the wind-up roll drive motor by supplying control voltage thereto; a sensor tangentially in contact with the roll which is radially displaced as the roll increases in diameter; an adjustable resistor ($R_o$) in the drive motor control voltage; a resistor ($R_1$) connected in series with the resistor ($R_o$) and forming a voltage divider therewith, and connected in parallel with the controller; and means operatively connected to the sensor for decreasing the resistance of the resistor ($R_o$) proportionally to the radial displacement of the sensor. Preferably, the resistor ($R_o$) comprises a slide resistor and the said means a sliding contact thereon.

Other objects, features, and advantages of the instant invention will become apparent to the skilled artisan upon examination of the following detailed description of the present invention, taken in conjunction with the figures of drawing.

DETAILED DESCRIPTION OF THE PREFERRED EMBODIMENTS

Figure 1:
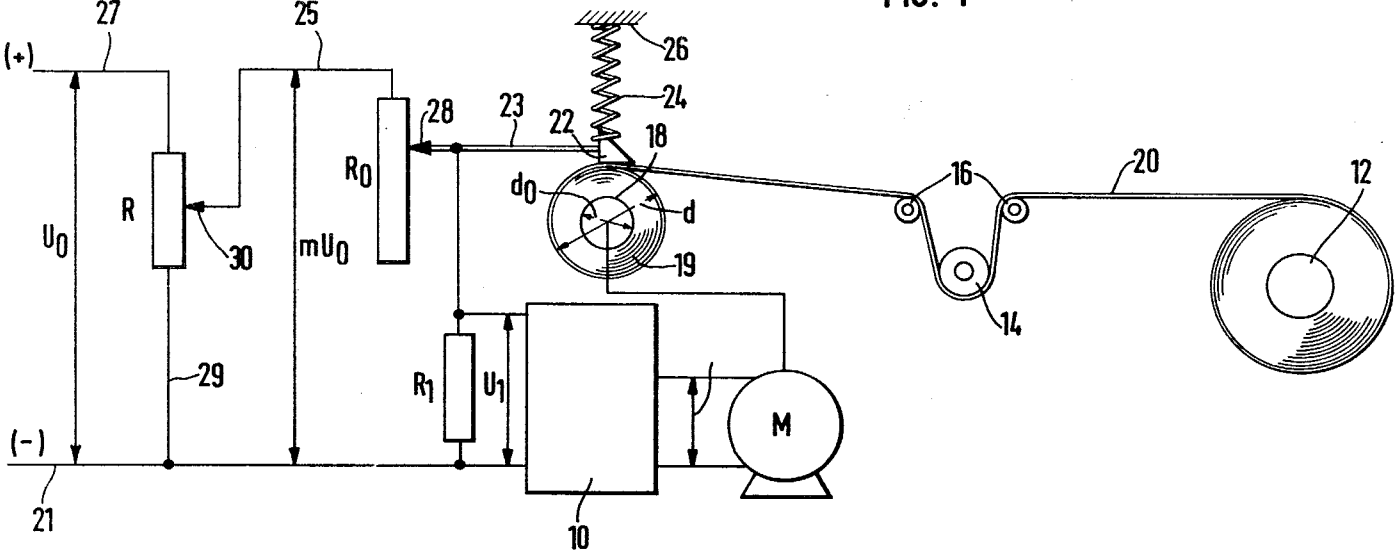
FIG. 1 is a schematic representation of one embodiment of the control arrangement according to the instant invention for keeping the web speed of material transported from a supply roll to a wind-up roll constant.

The advantage achieved through the use of the present invention is that a good control, which is qualitatively comparable with that of drives for high loads, is maintained over the web speed of a material during winding with a small degree of technical effort.

Before describing the control arrangement illustrated in FIG. 1, the relationship between the mechanical parameters, such as the speed n of the drive motor M and the diameter d of the wind-up roll, and the corresponding electrical actuating variables will be explained briefly.

If the web speed v is to be kept constant, the speed n of the drive motor M must decrease as the diameter d of a winding 19 on the roll 18 increases. The relationship between the speed n and the web speed v, in meters/minute, and the diameter d of the wind-up roll, in mm, is given by $$n = v \cdot 1000/d \cdot \pi \quad (1)$$

Thus, a constant web speed v is given by $$V = n \cdot d \cdot \pi/1000 \quad (2)$$

or $$v = n \cdot d \cdot K \text{ where } K = \pi/1000 \quad (3)$$

In order to ascertain an electrical actuating variable which is equivalent to the mechanical parameters, it is necessary to find a value which satisfies the condition of equation (3).

Figure 2:
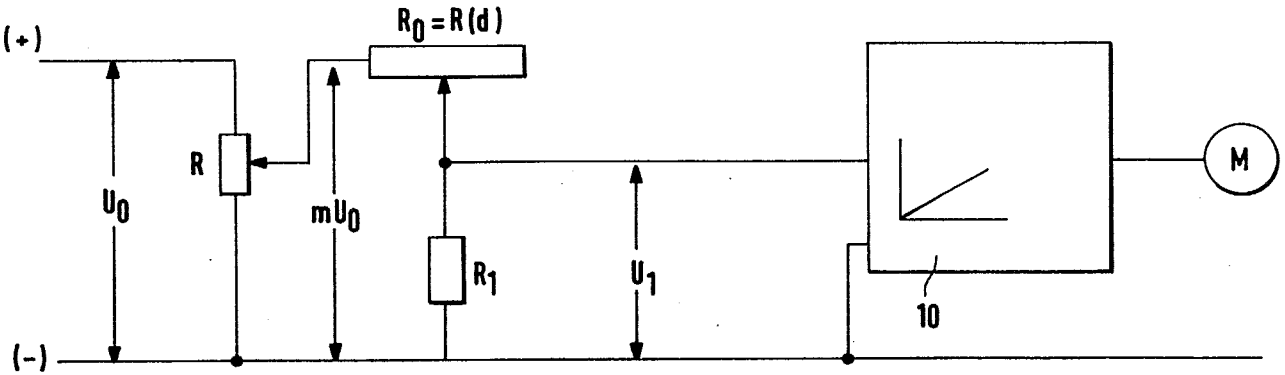
FIG. 2 is a block diagram of the control arrangement illustrated in FIG. 1.

It can be seen from the block diagram according to FIG. 2 of the control arrangement, that the control voltage $U_1$, which arises at a resistor $R_1$, for a constant input control voltage $U_o$, which is completely connected through a potentiometer R, is given by $$U_1 = mU_o \frac{R_1}{R_o + R_1} \quad (4)$$

where the voltage ratio factor m=1 at the point of connection of the potentiometer R, and $R_o = R_{(d)} = a \cdot d$, where d is the diameter of the wind-up roll.

This then gives $$U_1 = U_o \frac{R_1}{a \cdot d + R_1} \quad (5)$$

$$U_1 = U_o \frac{R_1}{a\left(d + \frac{R_1}{a}\right)} \quad (6)$$

Figure 3:
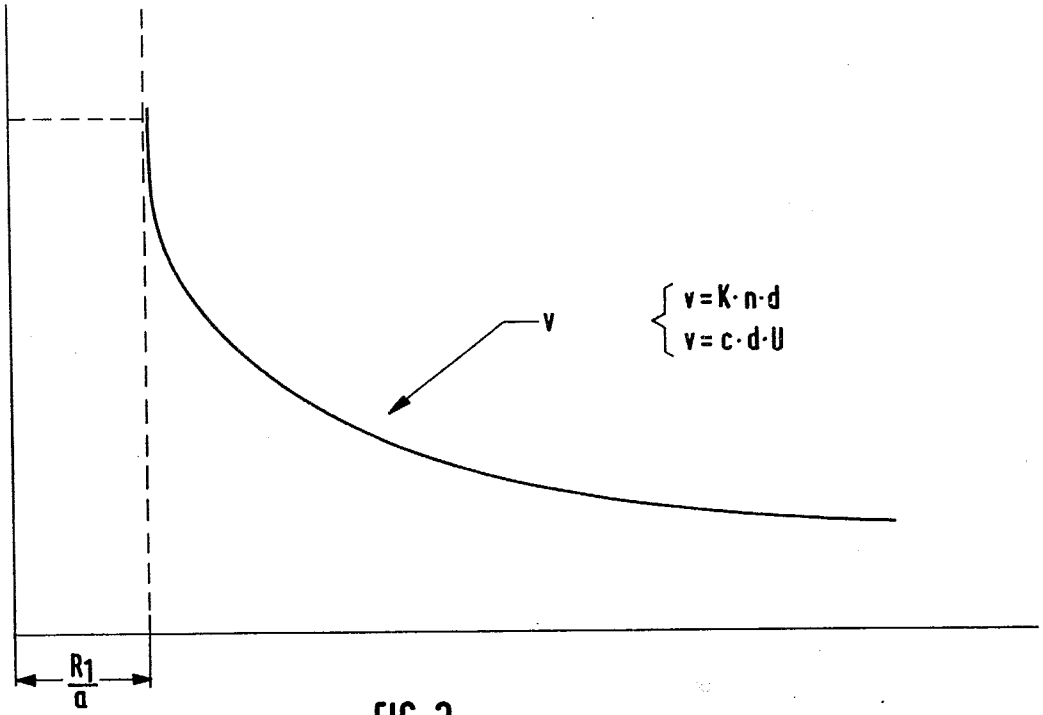
FIG. 3 illustrates the speed n of the drive motor of the wind-up roll as a function of the diameter d of the wind-up roll, or the diameter d of the roll as a function of a control voltage $U_{control}$.

FIG. 3 shows the hyperbolic curve characteristic of a hyperbolic drive, that is to say the functional relationship between the speed n and the diameter d of the winding, or between the diameter d of the winding and the control voltage $U_{control}$ of the drive motor M of the wind-up roll for a constant web speed v of the material to be wound up.

If a linear transformation of coordinates is carried out by shifting the ordinate axis in FIG. 3 by the amount $R_1/a$ until it assumes the position indicated by the broken line, $d + R_1/a$ minus the shift $d_o = R_1/a$ is then equal to d and it follows from equation (6) that $$U_1 = U_o R_1/a \cdot d \quad (7)$$

In practice, the value $d_o$ is taken as the diameter of the wind-up roll.

Technically, this transformation of coordinates means that the potentiometer R responds to, that is to say influences the input control voltage $U_o$, only when the diameter d of the winding on the wind-up roll is $d_o$.

This control arrangement can electrically precisely simulate the hyperbolic function only if the controller for the drive motor M is such that the speed of the drive motor satisfies the equation $$n_{Mot} = b \cdot U_{control} \quad (8)$$

where $n_{Mot}$ is the speed of the drive motor, b is a constant and $U_{control}$ is the control voltage of the drive motor. As can be seen from FIG. 2, there is linearly proportional relationship between the speed $n_{Mot}$ of the drive motor and its control voltage $U_{control}$.

The condition for exact simulation of the hyperbolic function by the control arrangement is thus $$U_{control} = U_1$$

It follows from equations (3) and (8) that $$n = v/d \cdot 1/K;\ n_{Mot} = b \cdot U_{control}$$

$$v/d \cdot 1/K = b \cdot U_{control} \quad (9)$$

Then, at a constant web speed v $$v = b \cdot K \cdot d \cdot U_{control} = c \cdot d \cdot U_{control} \quad (10)$$

where c is a constant.

As has already been mentioned supra., the product of the two mechanical parameters speed and torque, which give the tensile load, must be electrically simulated. Simulation is effected, as equation (10) shows, by means of the product of the diameter d of the winding and of the control voltage $U_{control}$ of the drive motor, which is equal to the control voltage $U_1$ of the controller.

Figure 4:
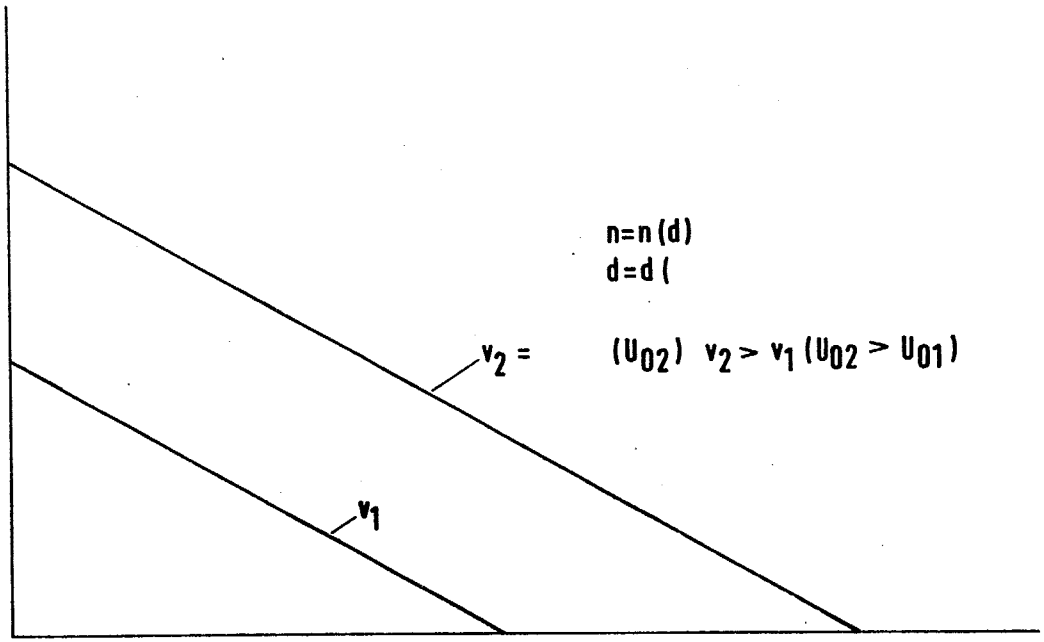
FIG. 4 is a log-log plot of the function illustrated in FIG. 3.

The plot in FIG. 4 shows how the web speed v of the material to be wound can be changed by changing the input control voltage $U_o$ without the necessity of changing the other parameters, such as the resistance value of the potentiometer R, the resistor $R_1$, or the constant a, which describes the relationship between the diameter d of the wind-up roll and the slide resistor R.

FIG. 1 shows schematically a winding device which is controlled by the control arrangement of the instant invention. The material 20, to be wound, is fed from a supply roll 12 via a first deflection roll 16, a compensating roll 14, and a second deflection roll 16 to the wind-up roll 18 which, for example, has a diameter $d_o$. The compensating roll 14 is a known device which will not be described in more detail, the object of which is to ensure, by means of an appropriate downwards or upwards movement, that the tension is always sufficient during braking or acceleration of the material during the winding process. A winding 19 on the wind-up roll 18 has a winding diameter d. The wind-up roll 18 is controlled by the drive motor M, which receives its control voltage $U_{control}$ from the controller 10.

A potentiometer R is connected on the input side of the control arrangement between the feed lines 21 and 27 and the tap 30 of this potentiometer is connected in parallel to the slide resistor $R_o$ via a line 25. The potentiometer R is connected to one feed line 21 via a line 29. The voltage connected through the potentiometer R is given by $m \cdot U_o$ where $m \leqq 1$, the exact value of which depends on the position of the sliding contact 30 on the potentiometer R. The potentiometer is an element providing set-point adjustment which can be set in accordance with a given value of the diameter of the winding 19, which is usually chosen to be equal to the diameter of the wind-up roll 18, above which the slide resistor $R_o$ is adjusted.

A sliding contact 28 on the slide resistor $R_o$ is combined, via a connector 23, with sensor 22 into a single unit. Appropriately, the design can be such that the sensor 22 at the same time functions as the tap 28 on the slide resistor $R_o$. The latter is connected, via its sliding contact 28, in series with the resistor $R_1$, and together with this forms a voltage divider. The control voltage $U_1$ is applied, as the input voltage for the controller 10, to the resistor $R_1$.

The sensor 22 is tangentially in contact with the circumference of the winder 19 at its highest point and it can be seen that, as the diameter of winding 19 increases, the sensor 22 and thus the sliding contact 28 on the slide resistor $R_o$, will be radially displaced, as a result of which the resistance value of $R_o$ will be changed and, thus, the voltage division via the voltage divider, formed from $R_o$ and $R_1$, will also be changed. The adjustment of the slide resistor $R_o$ is proportional to the change in the diameter of the winding 19 and, thus, the resistance value of $R_o$ is a function of the diameter d of the winding. The displacement of the sensor 22 is effected against the force of a compression spring 24, one end of which rests against the sensor 22, and the other end of which rests against a stop 26.

While the instant invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims.

What is claimed is:

1. A process for maintaining a constant material web speed during winding of a material onto a roll driven by a voltage controlled drive motor having an adjustable speed, comprising:

a. adjusting the speed of said drive motor of said roll to be linearly proportional to its control voltage; and b. as the diameter of the roll increases due to the winding of said material thereon, reducing the speed of said drive motor by measuring the increase in the diameter of said roll and hyperbolically decreasing the control voltage of said drive motor as a function of said increase in roll diameter.

2. The process of claim 1, wherein said control voltage is hyperbolically decreased as a function of the diameter of said roll by decreasing an adjustable resistance in the control voltage proportionally to said increase in roll diameter.

3. The process of claim 2, wherein said adjustable resistance in said control voltage is decreased only when the diameter of said roll is above a predetermined initial value.

4. The process of claim 1, wherein said increase in the diameter of said roll is measured by sensing the radial displacement of a sensor tangentially in contact with said roll as said roll increases in diameter.

5. An apparatus suitable for use in the process of claim 1, comprising:

a. a controller for controlling the speed of said roll drive motor by supplying control voltage thereto;

b. a sensor tangentially in contact with said roll which is radially displaced as said roll increases in diameter;

c. an adjustable resistor ($R_o$) in said drive motor control voltage;

d. a resistor ($R_1$) connected in series with said resistor ($R_o$) and in parallel with said drive motor controller, said resistor ($R_o$) and said resistor ($R_1$) forming a voltage divider; and e. means operatively connected to said sensor for decreasing the resistance of said resistor ($R_o$) proportionally to the radial displacement of said sensor.

6. The apparatus of claim 5, wherein said resistor ($R_o$) comprises a slide resistor and said means for adjusting the resistance of said resistor ($R_o$) comprises a sliding contact on the slide resistor ($R_o$).

7. The apparatus of claim 6, wherein said sensor is designed such that it functions as the sliding contact on said slide resistor ($R_o$).

8. The apparatus of claim 5, wherein said sensor is biased into tangential contact with said roll by a compression spring, one end of which is connected to said sensor, the other end of which is connected to a stop.

9. The apparatus of claim 5, further comprising means connected in parallel to said resistor ($R_o$) on the input side thereof for adjusting the control voltage in accordance with a predetermined initial diameter of the roll, above which adjustment of the resistance of the resistor ($R_o$) is effected.

10. The apparatus of claim 9, wherein said means for adjusting the control voltage in accordance with a predetermined initial diameter of said roll comprises a potentiometer.

* * * * *